US006243970B1

(12) United States Patent
Culp et al.

(10) Patent No.: US 6,243,970 B1
(45) Date of Patent: Jun. 12, 2001

(54) STACK OF LUMBER HAVING LOW RESISTANCE TO AIRFLOW THERETHROUGH AND ASSOCIATED METHOD

(75) Inventors: George W. Culp, New London; Robert T. Nagel, Raleigh, both of NC (US)

(73) Assignee: George R. Culp, New London, NC (US)

( * ) Notice: Subject to any disclaimer, the term of this patent is extended or adjusted under 35 U.S.C. 154(b) by 0 days.

(21) Appl. No.: 09/322,874

(22) Filed: May 28, 1999

(51) Int. Cl.[7] ..... F26B 3/00
(52) U.S. Cl. ..... 34/508; 34/518; 34/218
(58) Field of Search ..... 34/518, 77, 201, 34/218, 219, 202, 210, 231, 223, 225, 227, 232, 508

(56) References Cited

U.S. PATENT DOCUMENTS

| | | |
|---|---|---|
| 1,366,225 | 1/1921 | Weiss . |
| 1,469,976 | 10/1923 | Walsh . |
| 1,546,180 | 7/1925 | Osborn . |
| 2,713,364 | 7/1955 | Smith . |
| 3,757,428 | 9/1973 | Runciman . |
| 3,900,957 | 8/1975 | Denton et al. . |
| 4,261,110 | 4/1981 | Northway et al. . |
| 4,445,559 | 5/1984 | Coleman . |
| 4,663,860 | 5/1987 | Beall . |
| 4,788,777 | 12/1988 | Davis . |
| 5,488,785 | 2/1996 | Culp . |
| 5,704,134 | 1/1998 | Carter et al. . |
| 5,815,945 | 10/1998 | Ando . |

FOREIGN PATENT DOCUMENTS

| | | |
|---|---|---|
| 877 727 | 5/1953 | (DE) . |
| 537 568 | 5/1922 | (FR) . |

OTHER PUBLICATIONS

*Calculation of Drying Behaviour in Different Parts of a Timber Stack*, J–G Salin et al., Drying '98, Proceedings 11th International Drying Symposium (IDS '98), vol. 5., Aug. 1998, pp. 1603–1610.

*Primary Examiner*—Denise L. Ferensic
*Assistant Examiner*—Michelle O. Mattera
(74) *Attorney, Agent, or Firm*—Alston & Birds LLP

(57) ABSTRACT

A stack of lumber that can be efficiently dried includes a plurality of layers of lumber that are arranged one above the other and extend longitudinally and laterally. Each layer of lumber includes a first edge that extends in the longitudinal direction and at least partially defines a side of the stack of lumber. Many of the first edges of adjacent layers of lumber are laterally spaced apart by at least a predetermined separation distance so that the first edges define a staggered arrangement. Also, the layers of lumber that are adjacent are vertically spaced apart from one another so that each of the adjacent layers of lumber define a laterally extending passage therebetween. Each of the passages includes an inlet and an opposed outlet defined between two of the adjacent first edges that are vertically and laterally spaced apart from one another. The flow of air through the stack of lumber is distributed through the passages such that within each passage oppositely oriented boundary layers are formed. Each of those boundary layers includes a generally planar portion, which is proximate to the outlet of the respective passage, and a protruding portion, which is proximate to an inlet of the respective passage. For each passage, a peak of one of the protruding portions is downstream from a peak of the other of the protruding portions by at least the predetermined separation distance so as to reduce the restriction to airflow therethrough and thereby increase the size of the effective opening through which air can enter the passage.

25 Claims, 4 Drawing Sheets

STACK OF LUMBER HAVING LOW RESISTANCE TO AIRFLOW THERETHROUGH AND ASSOCIATED METHOD

FIELD OF THE INVENTION

The present invention relates generally to the drying of green lumber in a kiln and, more particularly, to a stack of lumber that is arranged to facilitate airflow therethrough as well as an associated method of drying lumber.

BACKGROUND OF THE INVENTION

Lumber which has recently been cut contains a relatively large percentage of water and is referred to as green lumber. Prior to being used in construction or other applications which demand good grades of lumber, the green lumber must be dried. Drying removes a large amount of water from the lumber and significantly reduces the potential for the lumber to become warped or cracked. Acceptable water content varies depending on the use of the lumber and type of wood; however, a moisture content of about nineteen percent, or less, is acceptable in many circumstances.

Although lumber may be dried in the ambient air, kiln drying accelerates and provides increased control over the drying process. In kiln drying, a charge of lumber is placed in a kiln chamber. A typical kiln chamber is a generally rectangular building which can be at least partially sealed to control the amount of air that is introduced to and exhausted from the kiln chamber. Further, such kiln chambers typically have reversible cans for circulating heated air through the chamber. The air may be heated in a number of ways, such as by a suspension furnace that exhausts hot air into the kiln chamber, or by heat transfer from steam-carrying pipes that extend through the chamber.

The charge of lumber placed in the kiln chamber typically consists of one or more rectangular stacks of lumber. It is conventional for each stack of lumber to consist of a number of vertically stacked, horizontal rows of lumber that are arranged such that cross-sections of the stack are generally rectangular. The horizontal rows are spaced apart with narrow wooden boards, or the like, referred to as "stickers." The stickers are positioned between each horizontal row to space the rows apart and to allow air to flow between the rows. The stacks of lumber are placed on separate flat-bed cars that are moved upon railroad-type tracks. Kilns may have any desired number of such tracks, and multi-track kilns may accept several stacks of lumber during each drying cycle.

In operation, a charge of green lumber is initially placed in a kiln chamber. After at least partially sealing the chamber, the air within the chamber is heated to facilitate drying. The fans within the chamber circulate the heated air through the kiln chamber. Because the stickers provide spaces between the horizontal rows of lumber, the heated air passes between the rows of lumber and is in direct contact with both the upper and lower surfaces of individual pieces of lumber so that the lumber is dried.

FIG. 1 is a perspective view of a conventional stack of lumber 10 that is to be dried in a kiln in the manner generally described above. More specifically, the stack 10 includes a first side 12 and an opposite second side 14, and multiple horizontally extending layers 16 of lumber that arc arranged one above the other and extend between the first and second sides. Each layer 16 includes multiple pieces of lumber 18. Multiple stickers or spacers 20, which are typically in the form of narrow pieces of lumber, are positioned between the layers 16 and extend between the opposite sides 12 and 14, so that multiple passages 22 are defined between adjacent layers 16 and are open at the opposite sides. Only a few of the layers 16, pieces of lumber 18, spacers 20 and passages 22 are identified with a reference numeral in FIG. 1. The stack 10 is positioned within the chamber of a kiln, and heated air is circulated in the chamber so that a flow of heated air is forced through each of the passages 22.

A representative passage 22 is best seen in FIG. 2, which is a cross-sectional view of a portion of the stack 10 taken along line 2—2 of FIG. 1. FIG. 2 diagrammatically illustrates boundary layers 24 that form while airflow is forced into the passages 22 via openings of the passages that are at the first side 12 of the stack 10. The direction of the airflow is generally designated by the arrows 23 in FIG. 2.

Each of the passages 22 of the stack 10 are generally identical; therefore, the flow into the passage 22 that is illustrated in FIG. 2 is generally representative of the flow into each of the passages 22 via the openings to the passages that are at the first side 12 of the stack 10. Whereas FIG. 2 has been described heretofore as being illustrative of airflow into the passages 22 via openings at the first side 12 of the stack 10, FIG. 2 is also illustrative of airflow into the passages via openings at the second side 14 of the stack, in which case FIG. 2 is a cross-sectional view of a portion of the stack taken along line A—A of FIG. 1.

As best seen in FIG. 2, for each of the passages 22, airflow therethrough is such that viscous layers of air are developed proximate to the surfaces of the pieces of lumber 518 that face and define the passage. Those viscous layers are referred to as boundary layers 24, which are not visible but are generally shown in dashed lines in FIG. 2. More specifically, the boundary layers 24, which are areas of retarded flow, are caused by the viscous interaction between the airflow through the passage 22 and the surfaces of the pieces of lumber 18 that define the passage, as well as interaction between the airflow and the lumber surfaces that are proximate to the inlet opening of the passage.

Each boundary layer 24 includes a protruding portion 26 that tapers to a generally planar portion 28. For each of the boundary layers 24, the protruding portion 26 is a portion of the boundary layer that has become separated from the surface or surfaces of the one or more pieces of lumber 18 that define the passage. The separation occurs because of interaction between the airflow and an edge or edges of the one or more pieces of lumber 18 that define the inlet to the passage.

As illustrated in FIGS. 1 and 2, it is conventional for the edges of the layers 16 to be aligned so that they extend in a common plane. As a result, for each of the passages 22, the protruding portions 26 of the boundary layers 24 are aligned in a manner that is very restrictive to flow, since the boundary layers are regions of retarded flow and thereby tend to block flow into the passage 22. More specifically, an unrestricted flow path exists only in that region between the boundary layers 24 of each of the passages 22. Those unrestricted flow paths are characterized by generally inviscid flow. However, within each passage 22, the protruding portions 26 are aligned to significantly restrict the flow such that the only unrestricted flow path is between the peaks of the protruding portions, as designated by the arrow 30 in FIG. 2.

The resistance to flow through the stack 10 that results from the alignment of the protruding portions 26 reduces the speed at which the pieces of lumber 18 can be dried, which can be disadvantageous. The resistance to flow through the stack 10 that results from the alignment of the protruding portions 26 also requires significant pressure increases to maintain the flowrate; therefore, the kiln fans, which force the airflow through the stack, must work excessively, which is disadvantageous.

SUMMARY OF THE INVENTION

The present invention solves the above problems by providing a stack of lumber having a staggered arrangement, as well as a kiln system for drying a stack of lumber and methods for stacking and drying a stack of lumber. The staggered arrangement is such that the stack of lumber is capable of facilitating airflow therethrough, so that the stack of lumber can be efficiently dried.

In accordance with one aspect of the present invention, the stack of lumber includes a plurality of layers of lumber that are arranged one above the other. Each layer of lumber extends in a longitudinal direction, which is defined between opposite ends of the stack, and a lateral direction, which is defined between opposite first and second sides of the stack. In accordance with one embodiment of the present invention, each layer of lumber includes a plurality of elongate lumber pieces which extend in the longitudinal direction. Each layer of lumber includes a first edge that extends in the longitudinal direction and at least partially defines the first side of the stack of lumber. The first edges of at least some of the adjacent layers of lumber are laterally spaced apart from one another by at least a separation distance so that the first edges define the staggered arrangement. The stack of lumber further includes a plurality of spacers positioned between the layers of lumber so that the adjacent layers of lumber are vertically spaced apart from one another. As such, each of the adjacent layers of lumber define at least one laterally extending passage therebetween. Each of the passages includes a first opening defined between the first edges of the adjacent layers of lumber that are vertically and laterally spaced apart from one another. In accordance with a first mode of operation of the present invention, heated airflow is forced through the passages via the first openings, whereby the first openings are inlets of the passages.

In accordance with one advantageous aspect of the present invention, the adjacent first edges are laterally spaced apart from one another in an alternating fashion, and the staggered arrangement is substantially uniform and extends continuously and substantially from a top of the stack of lumber to a bottom of the stack of lumber. Further, a first group of the first edges can lie substantially in a common first plane, and a second group of the first edges can lie substantially in a common second plane that is displaced from the first plane by the separation distance. In this embodiment, the first plane and the second plane are preferably substantially vertical.

In accordance with another aspect of the present invention, each layer of lumber further includes a second edge that extends in the longitudinal direction and at least partially defines the second side of the stack of lumber. Like the first side, the second edges of the adjacent layers of lumber are vertically spaced apart from one another such that each passage further includes a second opening defined between the second edges of the adjacent layers of lumber. In accordance with the first mode of operation of the present invention, which is mentioned above, the second openings are outlets of the passages. In accordance with a second mode of operation of the present invention in which the airflow is reversed, heated airflow is forced through the passages via the second openings, whereby the second openings are inlets of the passages and the first openings are outlets of the passages. The second edges preferably define a staggered arrangement similar to the staggered arrangement defined by the first edges.

In accordance with the present invention, the flow of air through the stack of lumber is distributed through the passages such that within each passage oppositely oriented boundary layers are formed. Each of those boundary layers includes a generally planar portion, which is proximate to the outlet of the respective passage, and a protruding portion, which is proximate to the inlet of the respective passage. For each boundary layer, the protruding portion thereof extends farther into the passage (in a direction that is generally perpendicular to the flow therethrough) than the generally planar portion, and the protruding portion tapers to the generally planar portion. For each passage, a peak of one of the protruding portions is downstream or otherwise displaced from a peak of the other of the protruding portions by at least the separation distance.

Each of the protruding portions typically has a predetermined length that extends in the general direction of the flow through the stack of lumber. For each passage, the upstream ends of the protruding portions are spaced apart from one another by the separation distance that extends in the general direction of the flow through the passage. The separation distance is preferably at least as great as fifty percent of the predetermined length, and is most preferably is at least as great as eighty percent of the predetermined length.

Because the protruding portions of the boundary layers within each of the passages are not aligned, and, more particularly, are offset by at least the separation distance, the restriction to flow through the passages that is caused by the protruding portions is diminished. Thus, the protruding portions do not limit airflow through the stack of lumber in as severe a manner as in conventional rectangular stacks of lumber. As such, the pieces of lumber can advantageously be dried in less amount of time, if desired. Also, the reduced resistance diminishes the pressure losses caused by airflow through the stack, which advantageously reduces the amount of work that must be performed by one or more circulating fans within a kiln in which the stack of lumber is dried.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 3:
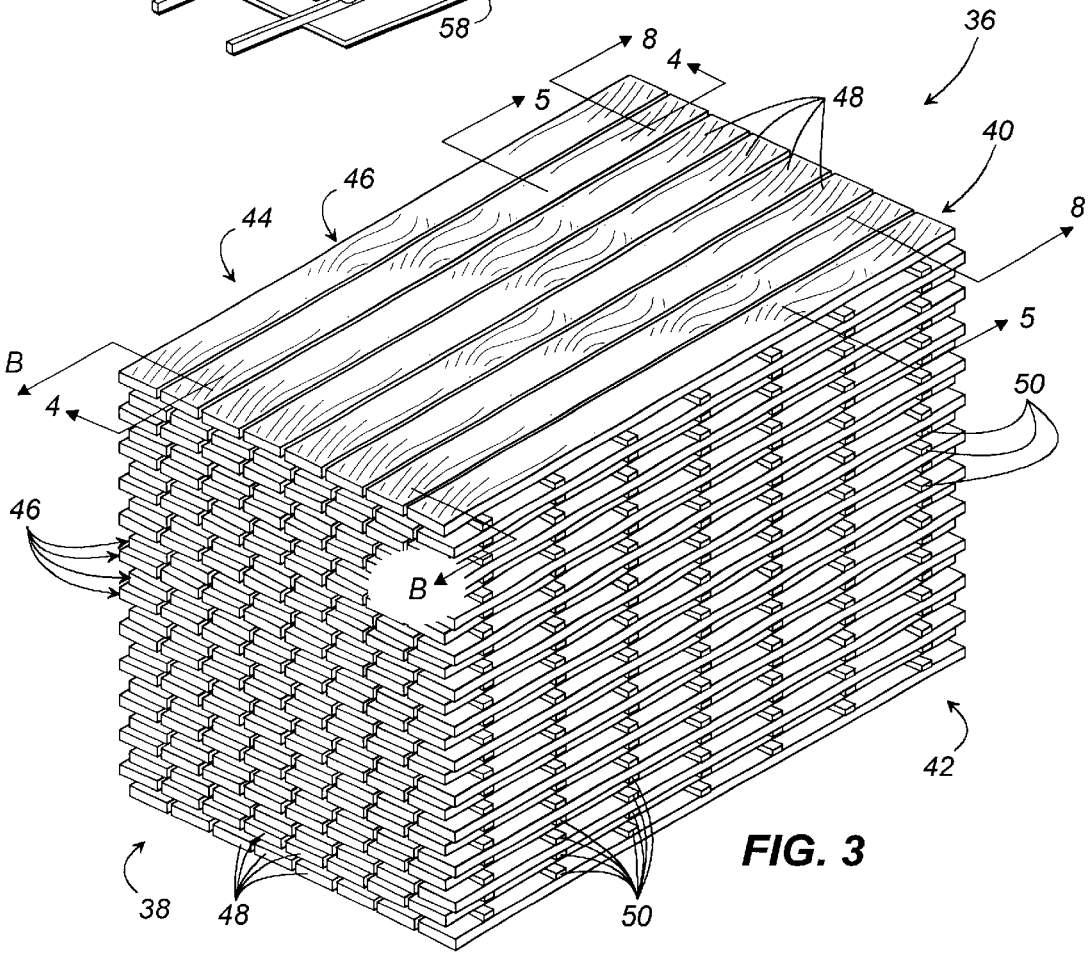
FIG. 3 is a perspective view of a stack of lumber that can be dried in a kiln and has edges that are laterally spaced apart from one another in an alternating fashion to define a staggered arrangement, in accordance with an embodiment of the present invention.

Referring to FIG. 3, a stack 36 of lumber according to an embodiment of the present invention will be described. As will be discussed in greater detail below, the stack 36 has a staggered arrangement such that the stack is capable of efficiently receiving airflow therethrough to promote the drying of the lumber thereof.

The stack 36 includes a front end 38 and an opposite rear end 40, and a longitudinal direction is defined between those ends. The stack 36 further includes a first side 42 and an opposite second side 44, and a lateral direction is defined between those sides. Whereas FIG. 3 is a perspective view of the top, front end 38 and first side 42 of the stack 36, a perspective view of the top, rear end 40 and second side 44 of the stack is identical to that which is illustrated in FIG. 3. Notwithstanding that the stack 36 is illustrated as extending farther in the longitudinal direction than the lateral direction, it is also within the scope of the present invention for the stack to extend farther in the lateral direction than the longitudinal direction.

Figure 4:
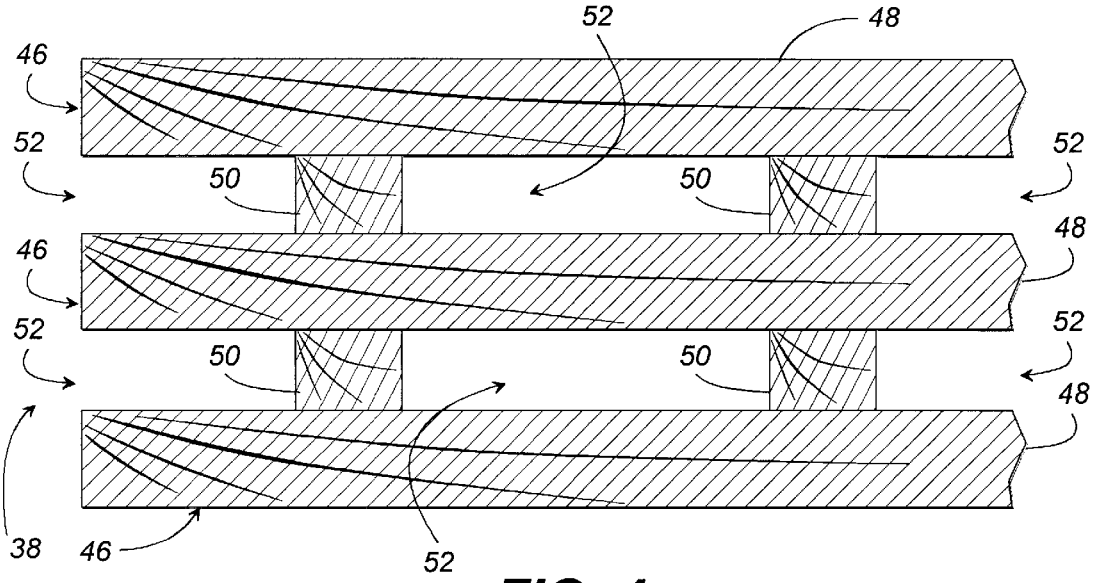
FIG. 4 is a cross-sectional view of a portion of the stack of FIG. 3 taken along line 4—4 of FIG. 3.
Figure 5:
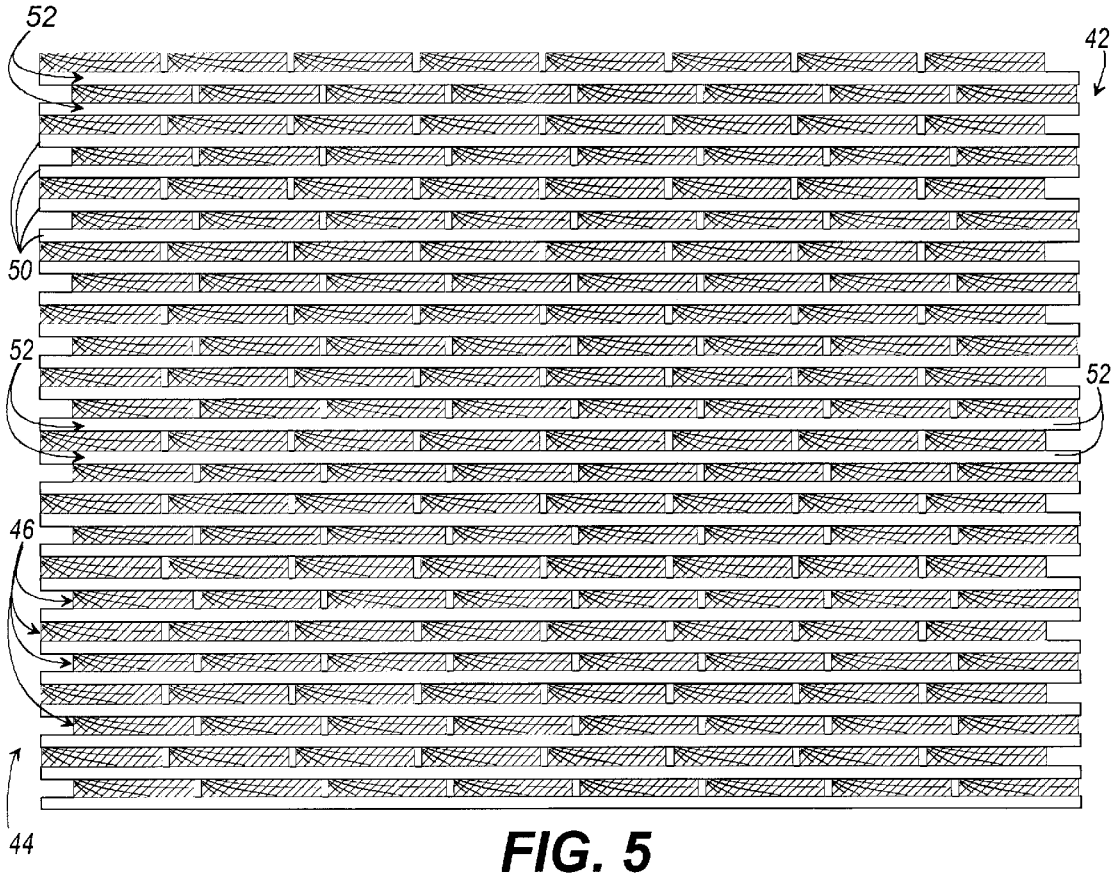
FIG. 5 is a cross-sectional view of the stack of FIG. 3 taken along line 5—5 of FIG. 3.
Figure 8:
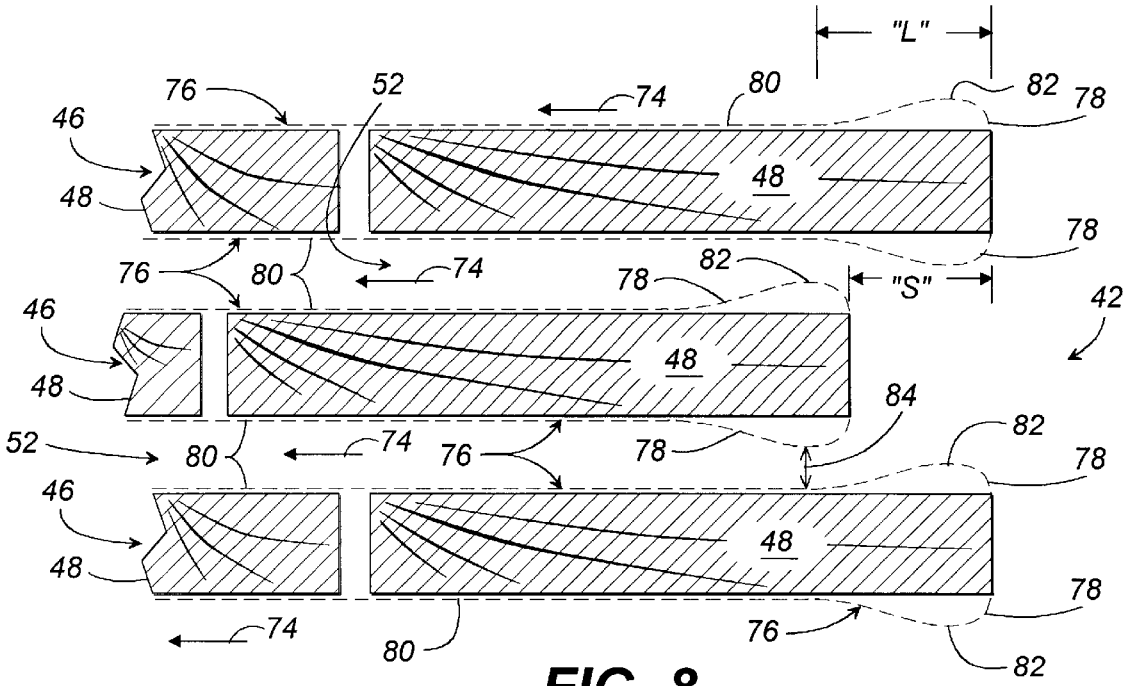
FIG. 8 is a cross-sectional view of a portion of the stack of FIG. 3 taken along line 8—8 of FIG. 3, wherein boundary layers resulting from airflow through the stack are diagrammatically shown by dashed lines, in accordance with an embodiment of the present invention.

The stack 36 includes multiple courses or layers 46 of lumber that are horizontally extending and arranged one above the other. Each layer 46 includes multiple pieces of lumber 48 that extend in the longitudinal direction. Adjacent layers 48 are vertically spaced apart by stickers or spacers 50, which are acceptably long and narrow pieces of lumber. The spacers 50 extend laterally between the sides 42 and 44 such that passages 52, which are best seen in FIGS. 4, 5 and 8, are defined between adjacent layers 46. Each of the passages 52 extends through the stack 36 and is open at the first side 42 and the second side 44 of the stack. As will be discussed in greater detail below, air is forced through the passages 52 to dry the pieces of lumber 48. Only a few of the layers 46, pieces of lumber 48 and spacers 50 are identified with their reference numerals in FIG. 3.

As best seen in FIG. 4, which is a cross-sectional view of a portion of the stack 36 taken along line 4—4 of FIG. 3, each of the passages 52 is at least partially defined between surfaces of adjacent layers 46 and a surface of at least one of the stickers 50. As best seen in FIG. 5, which is a cross-sectional view of the stack 36 taken along line 5—5 of FIG. 3, the adjacent edges of the layers 46 are laterally spaced apart from one another in an alternating fashion so that the edges at the first side 42 define a staggered arrangement and the edges at the second side 44 define a staggered arrangement. Only a few of the spacers 50, passages 52, layers 46 and pieced of lumber 48 are identified with their reference numerals in FIG. 3. FIGS. 4 and 5 are respectively representative of other longitudinal and lateral cross-sectional views of the stack 36.

Figure 6:
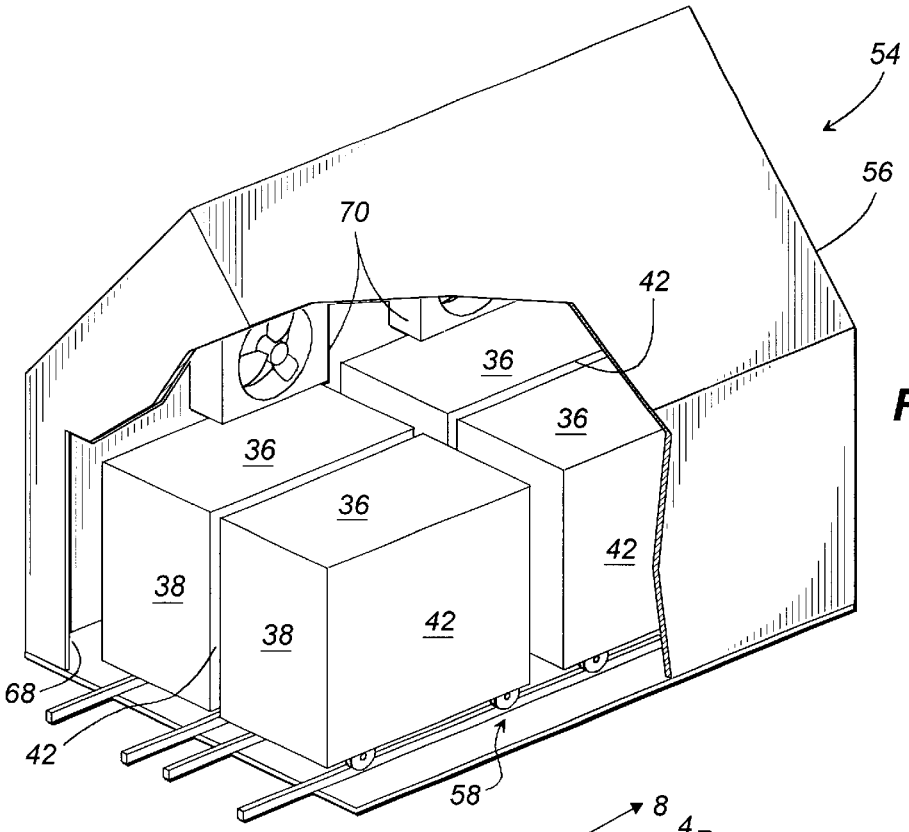
FIG. 6 is a diagrammatic, fragmented perspective view of a kiln containing multiple stacks of lumber, in accordance with an embodiment of the present invention.

FIG. 6 is a diagrammatic, fragmented perspective view of portions of a kiln 54 that contains a charge of lumber, which consists of several of the stacks 36 (also see FIG. 3), in accordance with an embodiment of the present invention. The kiln 54 includes a building 56 defining a chamber 58 that contains the charge. The building 56 further defines an inlet opening 68 at one end of the building 56 and an outlet opening (not shown) at the opposite end of the building. Those openings provide for the ingress and egress of the stacks 36 with respect to the chamber 58, and those openings are closed while the kiln 54 is operating. Multiple air moving devices, which are preferably in the form of fans 70, such as reversible fans, are arranged in an upper region of the chamber 58.

Figure 7:
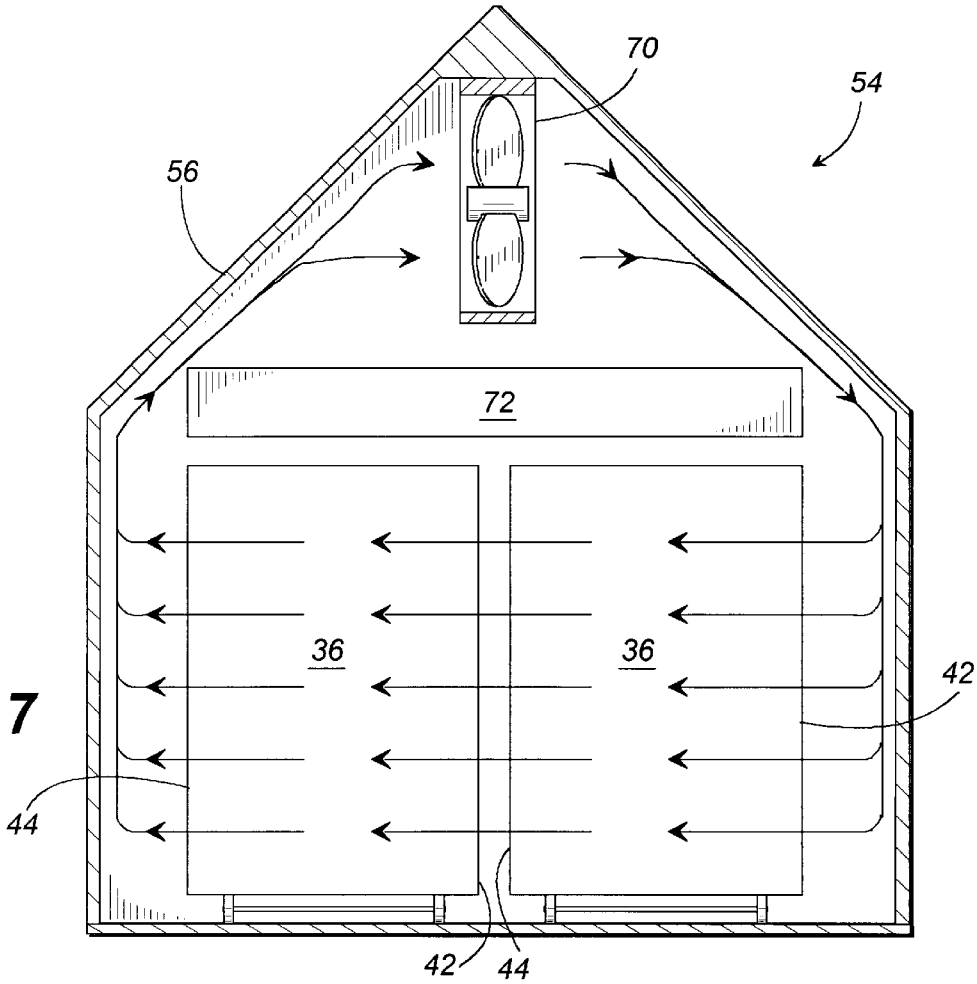
FIG. 7 is diagrammatic, end cross-sectional view of the kiln of FIG. 6 in operation, in accordance with an embodiment of the present invention.

FIG. 7 is a diagrammatic, end cross-sectional view of the kiln 54 of FIG. 6 in operation, in accordance with an embodiment of the present invention. As illustrated in FIG. 7, the fans 70 are operating to circulate air in a clockwise direction through the chamber 58 (as is shown by the clockwise oriented arrows of FIG. 7), such that airflow passes through the passages 52 (FIGS. 4, 5 and 8) of the stacks 36 within the chamber. The kiln 54 includes a plenum 72 that is positioned within the chamber 58 and is operative for heating the chamber. For example, in accordance with one embodiment of the present invention, a suspension furnace (not shown) provides heated air to the plenum 72 by way of ducts (not shown) and the heated air is discharged from the plenum into the chamber 58 to heat the air circulating within the chamber.

The heated air that is circulated within the chamber 58 flows through the passages 52 (FIGS. 4, 5, and 8) of the stacks 36 within the chamber to dry the pieces of lumber 48 (FIGS. 3–5 and 8) of the stacks. More specifically, the clockwise circulation of air that is illustrated in FIG. 7 forces airflow into the passages 52 via the openings of the passages that are at the first sides 42 of the stacks 36, and the airflow exits those passages via the openings of the passages that are at the second sides 44 of the stacks.

As illustrated in FIGS. 3, 5 and 8, the edges of the adjacent layers 46 that are at the first side 42 of the stack 36 are laterally spaced apart from one another in an alternating fashion so that those edges define a uniform staggered arrangement that preferably extends from the top to the bottom of the stack. Similarly, and as illustrated in FIGS. 3 and 5, adjacent edges of the layers 46 that are at the second side 44 of the stack 36 are also laterally spaced apart from one another in an alternating fashion so that those edges define a uniform staggered arrangement that typically extends from the top to the bottom of the stack. As will be described below, the edge of the adjacent layers are typically laterally spaced by at least a separation distance and, in one advantageous embodiment, the edge of the adjacent layers are each laterally spaced by the same separation distance. As will be discussed in greater detail below, airflow may be introduced into the first side 42 of the stack 36 or the second side 44 of the stack.

FIG. 8, which is a cross-sectional view of a portion of the stack 36 taken along line 8—8 of FIG. 3, illustrates boundary layers 76 that form while airflow is forced into the passages 52 via the openings of the passages that are at the first side 42 of a stack 36 and exit the passages via the openings of the passages that are at the second side 44 of the stack, in accordance with an embodiment of the present invention. The direction of the airflow is generally designated by the arrows 74. In accordance with an embodiment of the present invention, the openings of each of the passages 52 and the passages themselves are preferably generally identical, except that in an elevation view of either the front end 38 (FIG. 3) or the rear end 40 (FIG. 3) of the stack 36 (FIG. 3), every other of the passages can be characterized as being inverted, as will be discussed in greater detail below. Therefore, the passages 52 and boundary layers 76 illustrated in FIG. 8 are respectively representative with respect to flow into each of the passages 52 of the stack 36 via the openings to the passages that are at the first side 42 of the stack. Whereas FIG. 8 is illustrative of airflow into the passages 52 via the openings thereof at the first side 42 of the stack 36, FIG. 8 can also be illustrative of airflow into the passages via openings thereto at the second side 44 of the stack, in which case FIG. 8 is a cross-sectional view of a portion of the stack taken along line B—B of FIG. 3.

As best seen in FIG. 8, for each of the passages 52, the airflow therethrough while properly within an operating kiln, such as the kiln 54 discussed above with reference to FIGS. 6 and 7, is such that viscous layers of air are developed proximate to the surfaces of the layers 46 that face the passage. Those viscous layers are referred to as boundary layers 76, which are typically not seen but are diagrammatically shown in dashed lines in FIG. 8. More specifically, the boundary layers 76, which are areas of retarded flow, are caused by the viscous interaction between the airflow through the passage 52 and the surfaces of the pieces of lumber 48 that define the passage, as well as interaction between the airflow and the edge and other surfaces of the lumber that are proximate to the inlet opening of the passage.

Each boundary layer 76 includes a protruding portion 78 that tapers to a generally planar portion 80. For each of the boundary layers 76, the protruding portion 78 is a portion of the boundary layer that has become separated from the surface or surfaces of the one or more pieces of lumber 48 that define the passage. The separation occurs because of an edge or edges of the one or more pieces of lumber 48 that define the inlet opening to the passage. Thus, the protruding portion begins at the inlet opening of the respective passage 52 and extends away from the inlet in the direction of flow.

Due to the staggered arrangement of the stack 36 (FIG. 3), for each of the passages 52, the peak 82 of one of the protruding portions 78 is downstream or otherwise displaced from the peak of the other of the protruding portions by way of definition, for each of those protruding portions 78, the peak 82 is the portion thereof that extends farthest into the passage. As mentioned above, in an elevation view of either the front end 38 (FIG. 3) or the rear end 40 (FIG. 3) of the stack 36, every other of the passages 52 can be characterized as being inverted. That is, in accordance with one embodiment of the present invention, approximately fifty percent of the passages 52 of a stack 36 can be characterized as being part of a first group, and the remainder of the passages of that stack can be characterized as being part of a second group. For each of the passages 52 of the first group, the downstream peak 82 therein is at a higher elevation than the upstream peak therein, and for each of the passages of the second group, the downstream peak therein is at a lower elevation than the upstream peak therein.

In accordance with one embodiment of the present invention, each of the protruding portions 78 defines approximately a predetermined length "L" that extends in the general direction of the flow through the stack 36. In this regard, the length "L" of a representative protruding portion 78 of a boundary layer 76 generally extends from the edge of the respective layer of lumber to a location downstream at which the distance that the boundary layers extends into the associated passage 52 is 15% or less of the distance that the boundary layer extends into the passage at the peak of the protruding portion. For each passage 52, the upstream ends of the protruding portions are spaced apart from one another by at least a separation distance "S". Since boundary layers created by the interaction of the airflow with the adjacent layers of lumber that define the passage generally have substantially the same size and shape. The peaks of the protruding portions are also spaced apart by at least the separation distance. In accordance with one embodiment of the present invention, the separation distance "S" is at least as great as fifty percent of the length "L" and, more preferably, is at least as great as eighty percent of the length "L". Although the value of "S" and "L" are also dependent upon the radius of curvature of the edges of the layers of lumber 46 at the entrance ends of the passages 52 and the flow velocity within the passages, for a passage height of approximately ⅞ inch, pieces of lumber 48 that are approximately 2.0 inches thick and flow velocities of approximately 1500 feet per minute through the passages, "S" may be approximately 2.5 inches and "L" may be approximately 3.0 inches.

Figure 1:
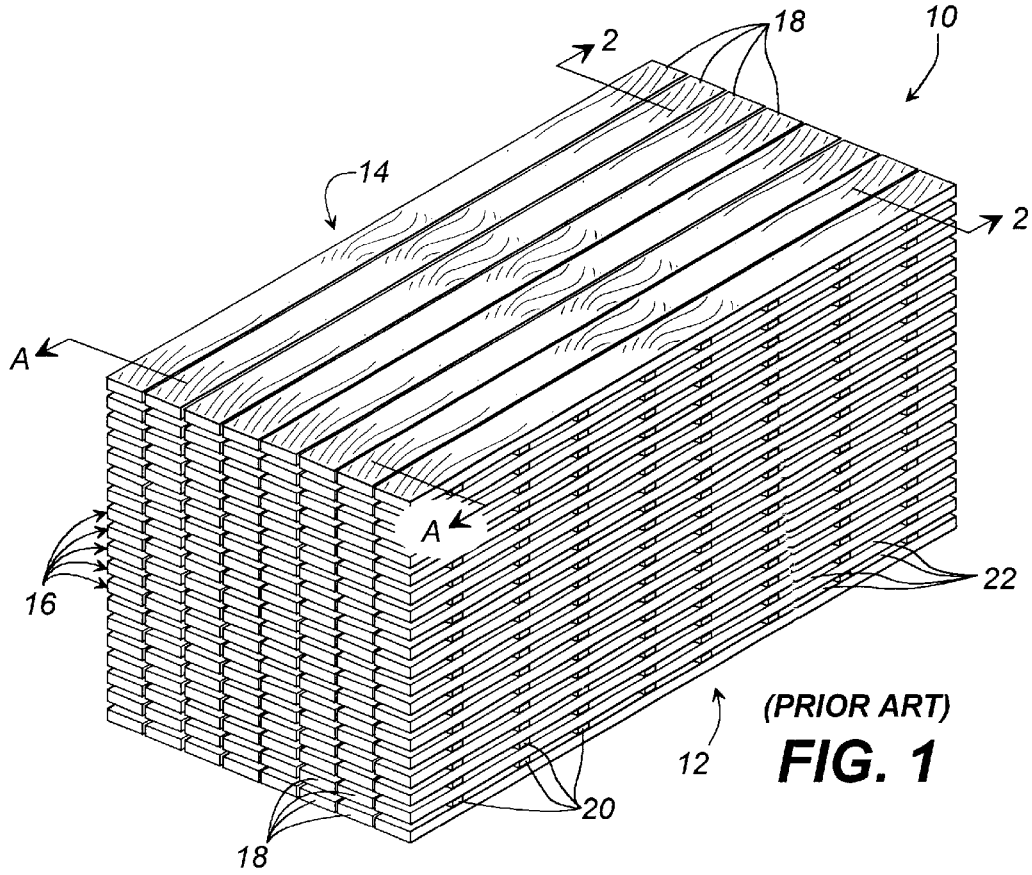
(PRIOR ART) FIG. 1
FIG. 1 is a perspective view of a conventional stack of lumber that can be dried in a kiln.
Figure 2:
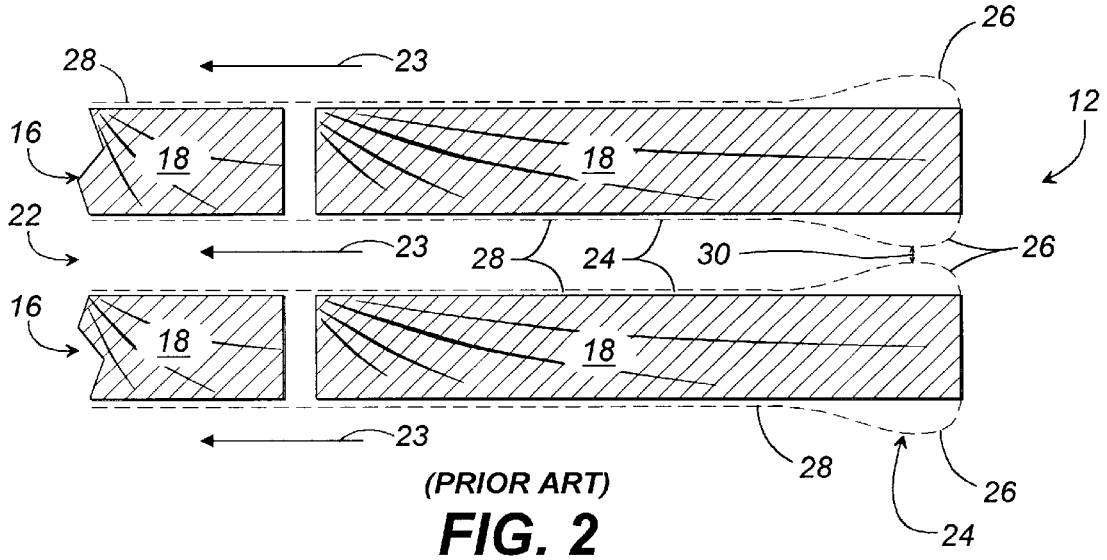
(PRIOR ART) FIG. 2
FIG. 2 is a cross-sectional view of a portion of the stack of FIG. 1 taken along line 2—2, wherein boundary layers resulting from airflow through the stack are diagrammatically shown by dashed lines.

For each of the passages 52, an unrestricted flow path, which is characterized by generally inviscid flow, is defined between the boundary layers 78 therein. As best seen in FIG. 8, due to the staggered arrangement of the edges of the layers 46, the narrowest portion of the unrestricted flow path is between the peak 82 of one of the boundary layers 76 and the generally planar portion 80 of the other of the boundary layers, as designated by the arrow 84. Due to the offset of the protruding portions of the boundary layers, the narrowest portion of the unrestricted flow path created by the stack of lumber of the present invention is significantly larger than the narrowest portion of the unrestricted flow path created by a conventional stack of lumber of similar size as shown in FIG. 2. As such, this resistance to flow designated by the arrow 84 does not severely restrict or limit airflow through the stack 36 (FIG. 3) such that the pieces of lumber 48 of the stack can be dried at a faster rate, which can be advantageous. Also, the offset boundary layers created by the stack of lumber of the present invention does not result in a significant pressure loss with respect to the airflow through the stack 36; therefore, the fans 70 (FIGS. 6 and 7), which force the airflow through the stack, need not work excessively, which is advantageous.

Stated differently or more specifically, the boundary layers 76 are caused by the contact of the air with the stationary lumber 48. When the air enters a passage 52, at least some of the air is required to make a sharp turn of approximately ninety degrees, which causes the airflow to separate from the surfaces of the layers of lumber 46 that define the passage, such that the protruding portions 78 of the boundary layers 76 are formed. The separation occurs because the viscous effects in the air are not able to balance the sudden change in momentum required to facilitate the sharp turn of approximately ninety degrees that is made by some of the air as it enters the passage 52. The separated regions, each of which is partially circumscribed by a respective one of the protruding portions 78, can be characterized as areas of little or no flow that function as blockages to flow entering the passages 52.

As best seen in FIG. 2, when the leading edges of the layers of lumber 16 that define a passage 22 therebetween are vertically aligned, the protruding portions 26 of the boundary layers 24 in that passage 22 are aligned and cooperate to provide a combined blockage effect that is more than two times the blockage effect caused by either of those protruding portions individually. That is, the magnitude of the blockage effect associated with a protruding portion 26 is proportional to the square of the mean velocity that occurs proximate to that protruding portion. And, the laws of conservation of mass dictate that an increase in velocity will occur between the peaks of the pair of protruding portions 26 within a passage 22.

In contrast, when the leading edges of the layers of lumber 46 that define a passage 52 therebetween are staggered as shown in FIG. 8, the protruding portions 78, and the blockage effects thereof, in that passage are arranged sequentially, so that the maximum blockage within the passage is that of one of those protruding portions. And, assuming similar operating conditions and other pertinent similarities, the flow rate past the protruding portions 78 within a passage 52 illustrated in FIG. 8 would be less than the flow rate past the protruding portions within a passage 22 illustrated in FIG. 2, which is important since blockage is proportional to velocity squared. Again assuming similar operating conditions and other pertinent similarities, because more blockage occurs in the upstream regions of the passages 22 illustrated in FIG. 2 than the upstream regions of the passages 52 illustrated in FIG. 8, the downstream portions of the boundary layers in the passages 22 may be more restrictive to flow than the downstream portions of the boundary layers in the passages 52.

Whereas the generally planar portions 28 (FIG. 2) and 80 (FIG. 8) of the boundary layers are shown as extending horizontally, downstream portions of the boundary layers slowly grow in thickness as they move along the lumber in the flow direction. The boundary layers grow until they fill the downstream portions of the passage and equilibrium is established.

Whereas it is preferred for a stack 36 to be perfectly symmetrical as illustrated in FIGS. 1–8, it is within the scope of the present invention for the stacks 36 to be less symmetrical than is illustrated or even completely unsymmetrical.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A stack of lumber arranged to facilitate airflow therethrough, the stack of lumber comprising:

a plurality of layers of lumber arranged one above the other, wherein each layer of lumber extends in both a longitudinal direction defined between opposite ends of the stack and a lateral direction defined between opposite first and second sides of the stack, each layer of lumber comprising a first edge that extends in the longitudinal direction and at least partially defines the first side of the stack of lumber, and a plurality of the first edges being laterally spaced apart from the first edges of the adjacent layers of lumber by at least a predetermined separation distance so that the first edges define a staggered arrangement that extends along a majority of the first side of the stack, and wherein each layer of lumber further comprises a second edge that extends in the longitudinal direction and at least partially defines the second side of the stack, and a plurality of the second edges being laterally spaced apart from the second edges of the adjacent layers of lumber by at least a predetermined, separation distance so that the second edges define a staggered arrangement that extends along a majority of the second side of the stack; and a plurality of spacers positioned between the layers of lumber so that the adjacent layers of lumber are vertically spaced apart from one another and at least one laterally extending passage is defined between adjacent layers of lumber, wherein at least some of the passages comprise a first opening defined between the first edges of the respective pair of adjacent layers of lumber that are vertically and laterally spaced apart from one another.

2. A stack of lumber according to claim 1, wherein each of the staggered arrangements is substantially uniform and extends substantially from a top of the stack of lumber to a bottom of the stack of lumber.

3. A stack of lumber according to claim 1, wherein the plurality of spacers comprises a plurality of laterally extending members, and each of the adjacent layers of lumber have at least two of the laterally extending members positioned therebetween.

4. A stack of lumber according to claim 1, wherein each layer of lumber comprises a plurality of elongate lumber pieces which extend in the longitudinal direction with any lateral spacing between immediately adjacent lumber pieces of the layer being less than the maximum lateral width of either of the immediately adjacent lumber pieces.

5. A stack of lumber according to claim 1, wherein:

a first group of the first edges lie substantially in a common first plane; and a second group of the first edges lie substantially in a common second plane that is displaced from the first plane by at least the predetermined separation distance.

6. A stack of lumber according to claim 5, wherein each of the first plane and the second plane extend substantially vertically.

7. A stack of lumber according to claim 5, wherein the first plane and the second plane are substantially parallel.

8. A stack of lumber according to claim 1, wherein each passage further comprises a second opening defined between the second edges of the respective pair of adjacent layers of lumber.

9. A stack of lumber according to claim 8, wherein each of the second openings is defined between the second edges of a respective pair of adjacent layers of lumber that are both vertically and laterally spaced apart from one another.

10. A stack of lumber according to claim 1, wherein:

a first group of the first edges lie substantially in a common first plane;

a second group of the first edges lie substantially in a common second plane that is different from the first plane;

a first group of the second edges lie substantially in a common third plane; and a second group of the second edges lie substantially in a common fourth plane that is different from the third plane.

11. A stack of lumber according to claim 10, wherein each of the first plane, the second plane, the third plane and the fourth plane extends substantially vertically.

12. A stack of lumber arranged to facilitate airflow therethrough, the stack of lumber comprising:

a plurality of substantially horizontally extending layers of lumber arranged one above the other, wherein the adjacent layers of lumber are vertically spaced apart from one another to thereby define respective passages therebetween, and the adjacent layers of lumber are arranged and operative so that the flow of air through the stack of lumber is distributed through the passages such that within each passage first and second boundary layers are formed, each boundary layer comprising a generally planar portion which is proximate to an outlet of the passage, and a protruding portion which is proximate to an inlet of the passage, wherein the protruding portion extends farther into the passage, in a direction that is generally perpendicular to the flow therethrough, than the generally planar portion, and where the protruding portion tapers to the generally planar portion, and wherein the first and second boundary layers are disposed adjacent different ones of the adjacent layers of lumber, and wherein each of the adjacent layers of lumber are arranged so that for each passage a peak of the first protruding portion is displaced from a peak of the second protruding portion by at least a predetermined separation distance.

13. A stack of lumber according to claim 12, wherein each of the protruding portions has a predetermined length that extends in the general direction of the flow through the stack of lumber, and wherein the layers of lumber are stacked such that the separation distance is at least as great as fifty percent of the predetermined length.

14. A stack of lumber according to claim 13, wherein the separation distance is at least as great as eighty percent of the predetermined length.

15. A stack of lumber according to claim 12, wherein each layer of lumber extends in both a longitudinal direction defined between opposite ends of the stack and a lateral direction defined between opposite first and second sides of the stack, each layer of lumber comprising a first edge that extends in the longitudinal direction and at least partially defines the first side of tile stack, a plurality of the first edges being laterally spaced apart from the first edges of the adjacent layers of lumber by at least a predetermined separation distance so that the first edges define a staggered arrangement that is substantially uniform and extends substantially from a top of the stack to a bottom of the stack.

16. A stack of lumber according to claim 15, wherein each layer of lumber comprises a plurality of elongate lumber pieces extending in the longitudinal direction with any lateral spacing between immediately adjacent lumber pieces of the layer being less than the maximum lateral width of either of the immediately adjacent lumber pieces.

17. A kiln system for drying lumber, the kiln system comprising:

a stack of lumber comprising:

a plurality of layers of lumber arranged one above the other, wherein each layer of lumber extends in both a longitudinal direction defined between opposite ends of the stack and a lateral direction defined between opposite first and second sides of the stack, each layer of lumber comprising opposite first and second edges, each first edge extending in the longitudinal direction and at least partially defining the first side of the stack of lumber, each second edge extending in the longitudinal direction and at least partially defining the second side of the stack of lumber, a plurality of the first edges being laterally spaced apart from the first edges of adjacent layers of lumber by at least a predetermined separation distance so that the first edges define a staggered arrangement that extends along a majority of the first side of the stack, and each layer further comprising a plurality of elongate lumber pieces extending in the longitudinal direction with any lateral spacing between immediately adjacent lumber pieces of the layer being less than the maximum lateral width of either of the immediately adjacent lumber pieces, and a plurality of spacers positioned between the layers of lumber so that the adjacent layers of lumber are vertically spaced apart from one another and at least one laterally extending passage is defined between adjacent layers of lumber;

wherein at least some of the passages comprise a first opening which is defined between the first edges of the respective pair of adjacent layers of lumber that are vertically and laterally spaced apart from one another, and each passage further comprises a second opening which is defined between two of the second edges that are adjacent, wherein the adjacent second edges are at least vertically spaced apart from one another;

a building defining a chamber containing the stack of lumber; and at least one air moving device that is operative for circulating air within the chamber and through the passages.

18. A kiln system according to claim 17, wherein:

a first group of the first edges lie substantially in a common first plane; and a second group of the first edges lie substantially in a common second plane that is displaced from the first plane by at least the predetermined separation distance.

19. A stack of lumber according to claim 18, wherein the first plane and the second plane are substantially parallel.

20. A kiln system according to claim 17, wherein:

the adjacent layers of lumber are arranged and the air moving device is operative so that within each passage, the flow of air therethrough forms first and second boundary layers, each boundary layer comprising a generally planar portion that is proximate to an outlet of the passage and a protruding portion that is proximate to an inlet of the passage, wherein the protruding portion extends farther into the passage, in a direction that is generally perpendicular to the flow therethrough, than the generally planar portion, and wherein the protruding portion tapers to the generally planar portion; and the first and second boundary layers are disposed adjacent different ones of the adjacent layers of lumber, and wherein each of the adjacent layers of lumber are arranged so that for each passage a peak of the first protruding portion is displaced from a peak of the second protruding portion by at least a predetermined separation distance.

21. A kiln system according to claim 20, wherein each of the protruding portions has a predetermined length that extends in the general direction of the flow through the stack of lumber, and wherein the layers of lumber are stacked such that the separation distance is at least as great as fifty percent of the predetermined length.

22. A kiln system according to claim 21, wherein the separation distance is at least as great as eighty percent of the predetermined length.

23. A method of drying lumber, comprising the steps of:

stacking a plurality of generally horizontally extending layers of lumber one above the other so that each of the adjacent layers of lumber are vertically spaced apart from one another and define at least one passage therebetween, wherein said stacking comprising offsetting at least some of the adjacent layers of lumber by at least a predetermined separation distance so that the edges of the offset layers of lumber define a staggered arrangement; and forcing air through the passages defined by the offset layers of lumber to at least partially dry the lumber and so that first and second boundary layers are formed within each passage, each boundary layer comprising a protruding portion that is proximate an inlet of the respective passage and a generally planar portion that is proximate an outlet of the respective passage, wherein for each boundary layer the protruding portion extends farther into the passage, in a direction that is generally perpendicular to the flow therethrough, than the generally planar portion and the protruding portion tapers to the generally planar portion, and wherein a peak of the protruding portion of the first boundary layer is downstream from a peak of the protruding portion of the second boundary layer by at least the predetermined separation distance.

24. A method of drying lumber according to claim 23, wherein the stacking step comprises the step of stacking the layers of lumber so that as a result of the forcing step each of the protruding portions has a predetermined length that extends in the general direction of the flow through the passages, and wherein said offsetting step comprises offsetting the layers of lumber such that the separation distance is at least as great as fifty percent of the predetermined length.

25. A method of drying lumber according to claim 23, wherein the stacking step comprises the step of stacking the layers of lumber so that as a result of the forcing step each of the protruding portions has a predetermined length that extends in the general direction of the flow through the passages, and wherein said offsetting step comprises offsetting the layers of lumber such that the separation distance is at least as great as eighty percent of the predetermined length.

* * * * *

UNITED STATES PATENT AND TRADEMARK OFFICE

CERTIFICATE OF CORRECTION

PATENT NO. : 6,243,970 B1
DATED : June 12, 2001
INVENTOR(S) : Culp et al.

It is certified that error appears in the above-identified patent and that said Letters Patent is hereby corrected as shown below:

Title page,
Item [74], in the firm name, "Birds" should read -- Bird --.

Column 10,
Line 4, after "predetermined" cancel the comma (,).

Column 11,
Line 40, "tile" should read -- the --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*